US011167307B2

(12) United States Patent
Viechter

(10) Patent No.: US 11,167,307 B2
(45) Date of Patent: Nov. 9, 2021

(54) METHOD AND APPLICATION GROUP FOR APPLYING A FLUID ONTO A SUBSTRATE

(71) Applicant: Canon Production Printing Holding B.V., Venlo (NL)

(72) Inventor: Manfred Viechter, Walpertskirchen (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/811,354

(22) Filed: Mar. 6, 2020

(65) Prior Publication Data

US 2020/0282420 A1 Sep. 10, 2020

(30) Foreign Application Priority Data

Mar. 8, 2019 (DE) ..... 102019105920.8

(51) Int. Cl.

| | |
|---|---|
| ***B05C 1/08*** | (2006.01) |
| ***B05C 1/10*** | (2006.01) |
| ***B05C 1/16*** | (2006.01) |
| *B05C 5/02* | (2006.01) |
| *B41F 15/08* | (2006.01) |
| *B05C 11/06* | (2006.01) |

(52) U.S. Cl.

CPC ..... *B05C 1/0834* (2013.01); *B05C 1/0813* (2013.01); *B05C 1/10* (2013.01); *B05C 1/165* (2013.01); *B05C 1/083* (2013.01); *B05C 5/025* (2013.01); *B05C 11/06* (2013.01); *B41F 15/0836* (2013.01)

(58) Field of Classification Search

None

See application file for complete search history.

(56) References Cited

U.S. PATENT DOCUMENTS 5,053,254 A * 10/1991 Billeter ..... B05C 1/10 101/129
5,476,546 A 12/1995 Zibulla
5,766,121 A * 6/1998 Spada ..... B65B 51/026 427/288

(Continued)

FOREIGN PATENT DOCUMENTS

| | | |
|---|---|---|
| DE | 11 15 120 B | 10/1961 |
| DE | 41 05 364 C1 | 5/1992 |
| EP | 2 177 191 A1 | 4/2010 |

OTHER PUBLICATIONS

German Action dated Dec. 17, 2019, for application No. 10 2019 105 920.8.

*Primary Examiner* — Binu Thomas

(74) *Attorney, Agent, or Firm* — Schiff Hardin LLP

(57) ABSTRACT

A fluid for application onto a substrate is provided in a cavity of a hollow cylindrical application roller that has porous roller wall. Before reaching the transfer point to the substrate, fluid is regionally selectively pushed back away from the outer shell surface of the application roller, into the porous roller wall, by a knockback pressure, in order to regionally selectively produce the effect that, at the transfer point, fluid is located at the outer shell surface of the application roller or no fluid is located at the outer shell surface of the application roller. A regionally selective application of fluid onto a substrate may thus be efficiently produced.

12 Claims, 4 Drawing Sheets

(56) References Cited

U.S. PATENT DOCUMENTS

| | | | | |
|---|---|---|---|---|
| 6,330,857 | B1 * | 12/2001 | Maximovsky | B41F 15/0836 101/116 |
| 6,458,211 | B1 * | 10/2002 | Wefers | B41F 15/0836 101/119 |
| 8,535,474 | B2 | 9/2013 | Morita et al. | |
| 2017/0120260 | A1 * | 5/2017 | Oetjen | B05C 1/10 |

* cited by examiner

METHOD AND APPLICATION GROUP FOR APPLYING A FLUID ONTO A SUBSTRATE

CROSS REFERENCE TO RELATED APPLICATIONS

This patent application claims priority to German Patent Application No. 102019105920.8, filed Mar. 8, 2019, which is incorporated herein by reference in its entirety.

BACKGROUND

Field

The disclosure relates to a method and a corresponding application group that enable a fluid, in particular a finish, to be flexibly and efficiently applied onto a substrate, in particular onto a recording medium that has been printed to.

Related Art

To produce a packaging, for example a cuboid box, a planar recording medium—for example made of corrugated paperboard—may be printed to in order to produce a printed folding box for the packaging. The printed folding box may then be folded or creased at defined fold or, respectively, crease points and be glued at defined glue points, in order to produce the three-dimensional packaging.

The printed recording medium is typically coated with a (water-based) finish in order to provide a high-grade packaging. However, the finish layer is thereby disadvantageous to the gluing of the packaging at the glue points, since the finish layer may reduce the adhesion effect or the adhesion force of the adhesive that is used. In order to nevertheless achieve a sufficient adhesive effect, special adhesives may be used for finished surfaces. However, these adhesives are typically linked with higher costs. Furthermore, different adhesives typically need to be used for different finish types, which increases the logistical cost in the manufacturing of a packaging.

Alternatively, a flexography print group may be used for finishing, wherein the print group has a plate cylinder via which it is produced that no finish is applied onto the recording medium at the one or more glue regions of the packaging. However, the use of a flexography print group in conjunction with a digital printing device is disadvantageous since the flexography print group may only be adapted to changes of the glue regions at a relatively high cost. Furthermore, the synchronization between the print group of a digital printing device and the plate cylinder is typically linked with a relatively high cost, and may not even be possible (for example due to varying distances between plate-shaped recording media following directly one after another).

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 3A:
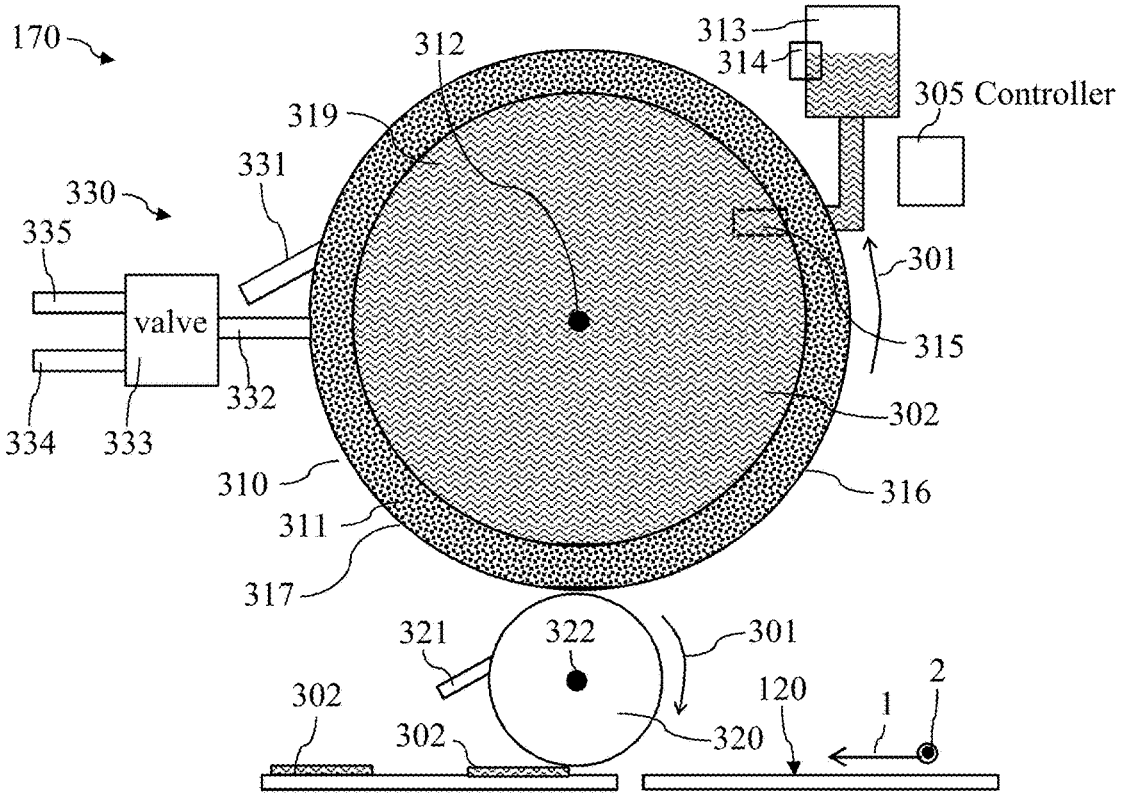

FIG. 3*a* illustrates a finish group having a porous application roller according to an exemplary embodiment.

Figure 3B:
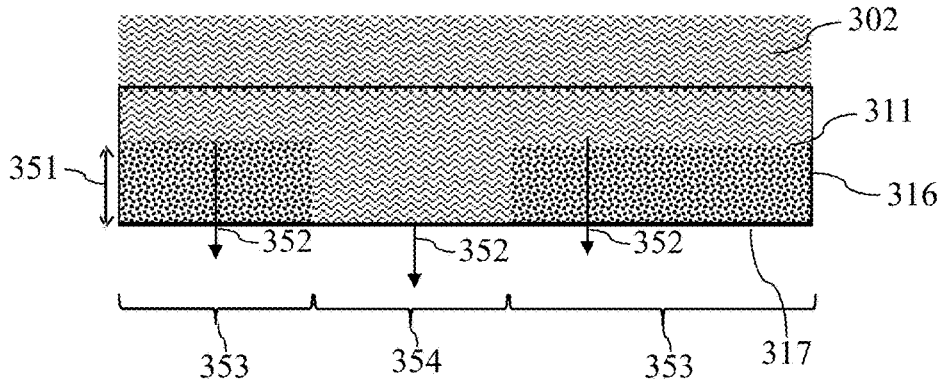

FIG. 3*b* illustrates example segments of the porous roller wall of an application roller directly following the knockback pressure generator according to an exemplary embodiment.

Figure 3C:
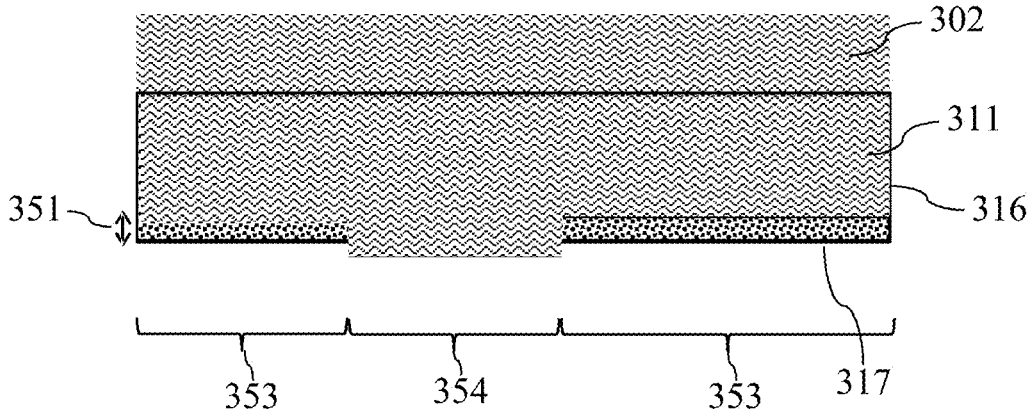

FIG. 3*c* illustrates examples of segments of the porous roller wall of an application roller at the transfer point to a transfer roller or to a substrate according to an exemplary embodiment.

Figure 3D:
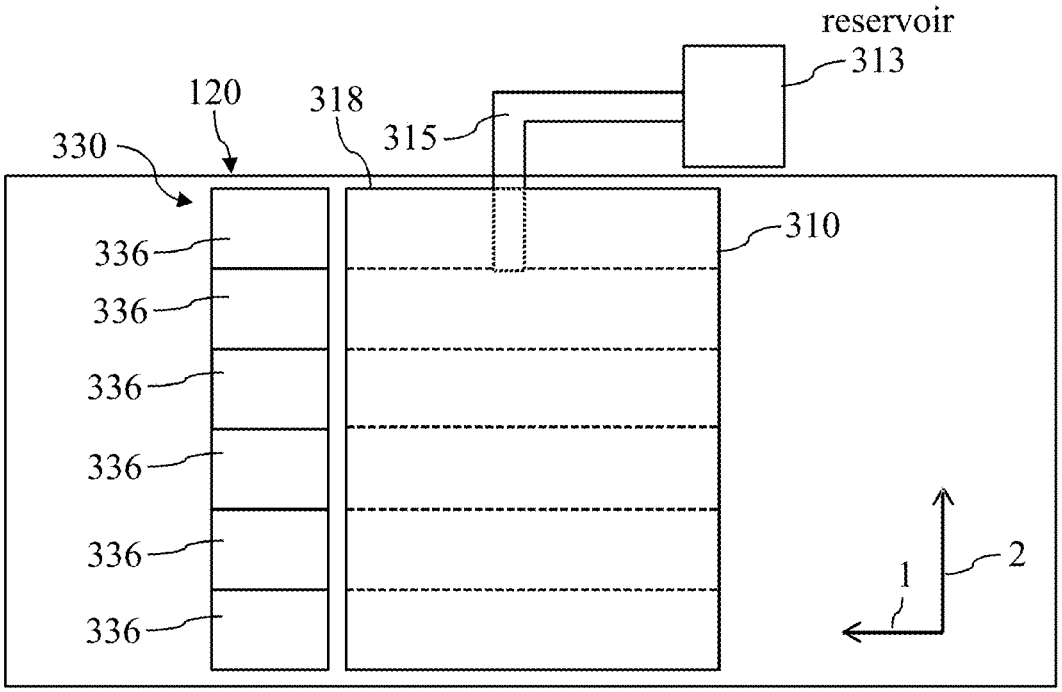

FIG. 3*d* illustrates an example of a segmentation of the knockback pressure generator and of the application roller according to an exemplary embodiment.

Figure 3E:
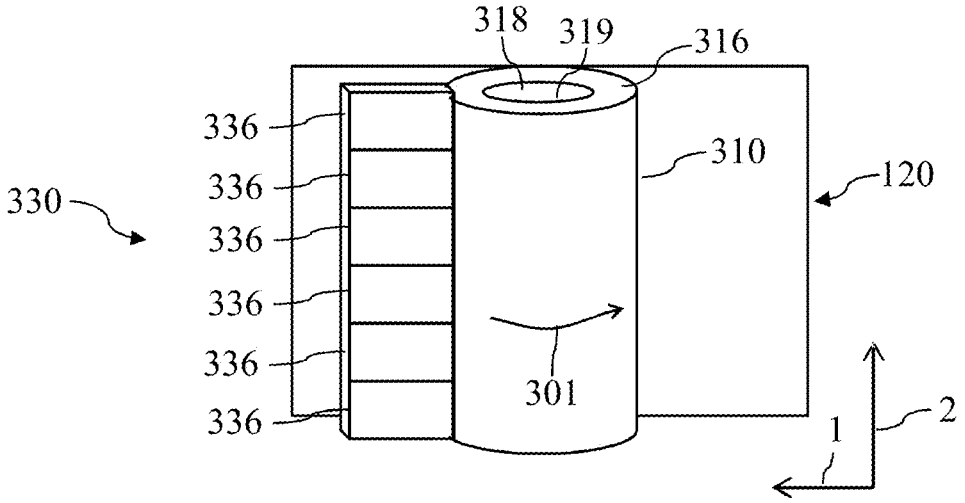

FIG. 3*e* illustrates an application roller with knockback pressure generator, in a perspective view, according to an exemplary embodiment.

Figure 4:
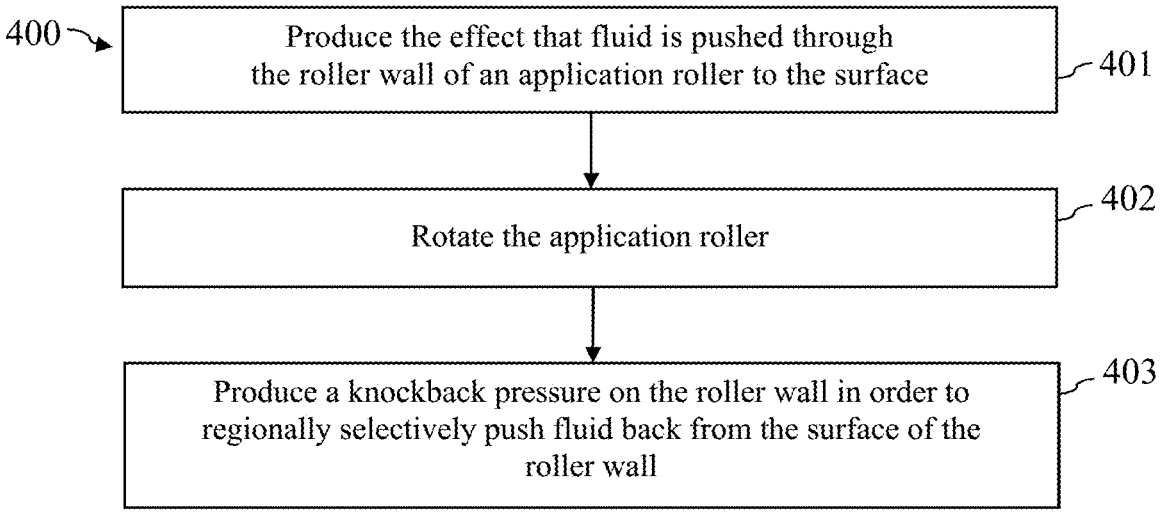

FIG. 4 illustrates flowchart of a method for regionally selective application of fluid (e.g. finish) onto a substrate according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to enable a flexible and cost-efficient, regionally selective application of a fluid, in particular a finish, onto a substrate, in particular in order to produce a substrate having one or more finished and one or more unfinished regions.

According to one aspect of the disclosure, an application group is described for applying a fluid onto a substrate. The application group includes a hollow or hollow cylindrical application roller having a porous roller wall, wherein the fluid to be applied onto the substrate is located in a cavity of the application roller, said cavity being surrounded by the roller wall. The application roller is designed such that the fluid moves with an extrusion speed through the roller wall toward the outer shell surface of the application roller due to an internal pressure. Moreover, the application group includes a movement means that is configured to rotate the application roller with a rotation speed in a rotation direction. In an exemplary embodiment, the application group also includes a knockback [kickback; recoil] pressure generator, arranged before a transfer point to the substrate, which is configured to push fluid away from the outer shell surface of the application roller, toward the cavity of the application roller, in a regionally selective manner by producing a knockback pressure.

The extrusion speed, the rotation speed, and the knockback pressure are matched to one another such that, in a first region of the outer shell surface of the application roller in which the knockback pressure has been produced by the knockback pressure generator, no fluid is located on the outer shell surface of the application roller when the first region reaches the transfer point, and, in a second region of the outer shell surface of the application roller in which the knockback pressure has not been produced, fluid is located on the outer shell surface of the application roller when the second region reaches the transfer point.

According to a further aspect of the disclosure, a method is described for applying a fluid onto a substrate. The method includes producing the effect that fluid moves, with an extrusion speed, through a porous roller wall from a cavity of an application roller toward the outer shell surface of the application roller. The method also includes the rotation of the application roller with a rotation speed in a rotation direction. Moreover, the method includes the selective production of a knockback pressure at a knockback point arranged before (in the rotation direction) a transfer point to the substrate, said knockback point being on the outer shell surface of the rotating application roller, in order to push fluid away from the outer shell surface of the application roller, toward the cavity of the application roller, in a regionally selective manner.

Figure 1:
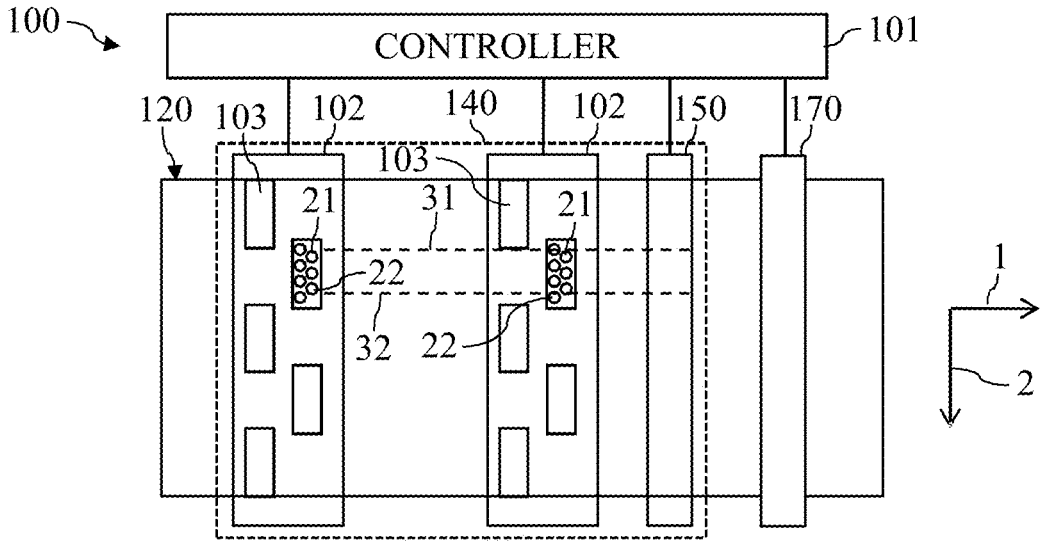
FIG. 1 illustrates an inkjet printing device having a finish group according to an exemplary embodiment.

FIG. 1 illustrates a printing device (printer) 100 according to an exemplary embodiment. The printer 100 is configured to print to a recording medium 120 in the form of a sheet or page or plate or belt. The recording medium 120 may be produced from paper, paperboard, cardboard, metal, plastic, textiles, a combination thereof, and/or other materials that are suitable and can be printed to. In particular, the recording medium 120 may be produced from corrugated paperboard. The recording medium 120 is directed along the transport direction 1 (represented by an arrow) through the print group 140 of the printing device 100. Successive recording media 120 may thereby have a defined distance from one another. In a printing device 100, in particular rigid, plate-like recording media 120 may be moved through the print group 140 with the aid of a transport belt. The aspects described in this document are described in conjunction with an inkjet printing device, but are generally applicable to printing devices (for example also toner-based printing devices) or even independently of a printing device.

In the depicted example, the print group 140 of the printing device 100 includes two print bars 102, wherein each print bar 102 may be used for printing with ink of a defined color (for example black, cyan, magenta, and/or yellow, and if applicable MICR ink). Different print bars 102 may be used for printing with respective different inks. Furthermore, the printing device 100 typically includes at least one fixing unit 150 that is configured to fix a print image printed on the recording medium 120. The fixing unit 150 can be referred to as a fixer.

A print bar 102 may include one or more print heads 103 that, if applicable, are arranged side by side in a plurality of rows in order to print the dots of different columns 31, 32 of a print image onto the recording medium 120. In the example depicted in FIG. 1, a print bar 102 includes five print heads 103, wherein each print head 103 prints the dots of one group of columns 31, 32 of a print image onto the recording medium 120.

In an exemplary embodiment, each print head 103 of the print group 140 includes a plurality of nozzles 21, 22, wherein each nozzle 21, 22 is configured to fire or eject ink droplets onto the recording medium 120. A print head 102 of the print group 140 may, for example, include multiple thousands of effectively utilized nozzles 21, 22 that are arranged along multiple rows transversal to the transport direction 1 of the recording medium 120. By means of the nozzles 21, 22 of a print head 103 of the print group 140, dots of a line of a print image may be printed on the recording medium 120 transversal to the transport direction 1, meaning along the width of the recording medium 120.

In an exemplary embodiment, the printing device 100 also includes a controller 101 (for example an activation hardware and/or a processor) that is configured to control the actuators of the individual nozzles 21, 22 of the individual print heads 103 of the print head 140 in order to apply the print image onto the recording medium 120 depending on print data.

In an exemplary embodiment, the controller 101 includes processor circuitry that is configured to perform one or more functions and/or operations of the controller 101, including controlling the actuators of the individual nozzles and/or controlling the overall operation of the printing device 100.

In an exemplary embodiment, the printing device 100 also includes a finishing unit or a finish group (finisher) 170, or cooperates with a finishing unit or with a finish group 170. In an exemplary embodiment, the finish group 170 is configured to coat the printed recording medium 120 with a finish layer. A water-based finish is thereby preferably used in printing to packaging. The finishing unit or a finish group 170 can also be referred to as a finisher.

Figure 2:
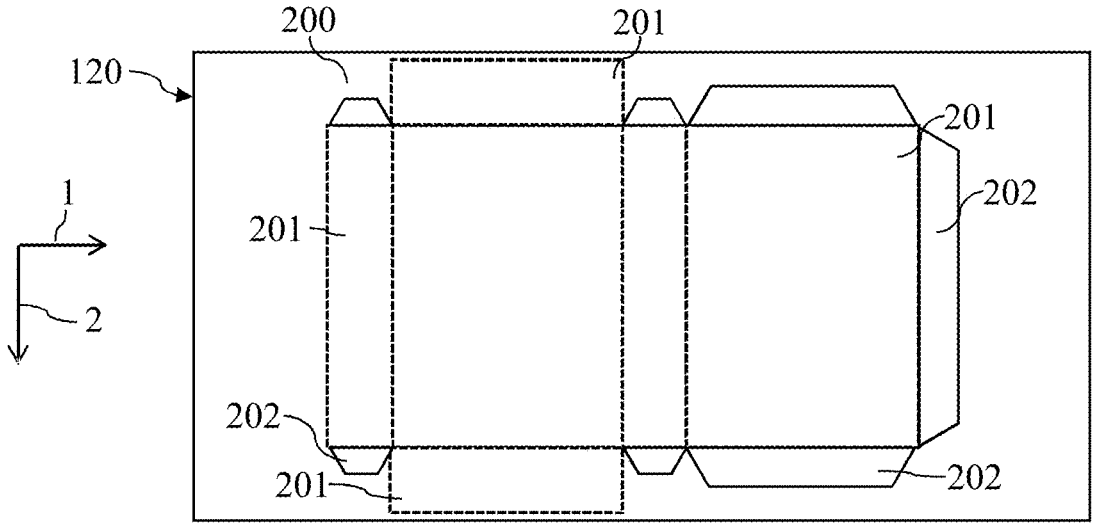
FIG. 2 illustrates a recording medium that has been printed to according to an exemplary embodiment.

FIG. 2 shows a printed recording medium 120 from which a folding box 200 may be punched out. FIG. 2 shows in particular the outline of the folding box 200. The folding box 200 typically includes one or more printed regions 201 in which print color is applied, in particular ink. In particular, the one or more print regions 201 may be printed to by the print group 140 depending on print data (for example with a defined print image). Furthermore, the folding box 200 typically has one or more regions 202 in which for the most part no print color is applied, in particular no ink. To produce a packaging, typically an adhesive is applied onto the one or more regions 202. Furthermore, the printed folding box 200 is creased and possibly folded (at the dashed lines) and glued at the regions 202 covered with adhesive. For example, a cuboid box may be produced with the folding box 200 depicted in FIG. 2.

To protect the printed print regions 201 and to provide a high-grade packaging, the folding box 200 may be coated with a finish layer. No finishing of the one or more regions 202 thereby preferably takes place, since a finish layer typically has a negative effect on the adhesive effect of an adhesive. For this purpose, the finish group 170 may be configured to apply the finish onto the recording medium 120 in a regionally selective manner.

FIG. 3*a* shows a finish group 170, according to an exemplary embodiment, having a hollow or hollow cylindrical application roller 310 that has a porous roller wall 316. It is noted that the aspects described in the following for a finish group 170 apply in general to an application group that is configured to apply a fluid onto a substrate. The application roller 310 has a width, along the transverse direction 2 traveling transversal to the transport direction 1, that corresponds to the width to be finished of a recording medium 120, or in general of a substrate 120. In FIG. 3*a*, the application roller 310 is shown from the side with a view of an end face 318 of the application roller 310. In FIG. 3*d*, the application roller 310 is also shown from above with a view of the shell surface of the application roller 310. Moreover, the application roller 310 is shown in a perspective view in FIG. 3*e*.

In an exemplary embodiment, the application roller 310 has a porous roller wall 316 with a plurality of pores 311, wherein the pores 311 are of such a size that finish 302 (or in general a fluid) may travel from the cavity 319 of the application roller 310, through the roller wall 316, to the outer surface or shell surface 317 of the roller wall 316, if the fluid pressure $p_s$ in the cavity 319 of the application roller 310 exceeds the ambient pressure $p_u$ of the application roller 310. The fluid pressure and/or the internal pressure $p_s$ in the cavity 319 of the application roller 310 may, for example, be adjusted using the fill level of finish 302 in the cavity 319 and/or using a pump (not shown). The fluid pressure and/or internal pressure may be the hydrostatic pressure of the finish 302 in the cavity 319, which is composed of the pressure produced by the gravitational force of the finish 302 and the pressure on the surface of the finish 302 in the cavity 319.

In the example depicted in FIG. 3*a*, finish 302 is supplied from a reservoir 313 to an end face of the application roller 310 via a supply line 315. A sensor 314 (for example a pressure sensor and/or a fill level sensor) is arranged in the cavity 319 of the application roller 310. A controller 305 of the finish group 170 may be configured to control the supply of finish 302 into the cavity 319 and/or into the reservoir 313 depending on sensor data of the sensor 314, in particular in order to adjust the fluid pressure $p_s$ in the cavity 319 of the application roller 310 to a defined nominal pressure value, and/or in order to adjust the differential pressure $p_s-p_u$ to a defined nominal value. The extrusion speed and/or the extrusion force 352 with which finish 302 is extruded from the cavity 319, through the roller wall 316, to the outer shell surface 317 of the roller wall 316, may be adjusted via the adjustment of the fluid pressure $p_s$ and/or of the differential pressure $p_s-p_u$. In an exemplary embodiment, the controller 305 includes processor circuitry that is configured to perform one or more functions and/or operations of the controller 305, including controlling the supply of finish 302 into the cavity 319 and/or into the reservoir 313 depending on sensor data of the sensor 314.

The hydrostatic fluid pressure $p_s$ includes a first pressure component that depends on the force of gravity or, respectively, the weight of the finish 32 in the cavity 319. This first pressure component is highest at the lowermost point of the roller wall 316 and zero at the uppermost point of the roller wall 316. Furthermore, an additional second pressure component of the hydrostatic fluid pressure $p_s$ may possibly be produced by the fill level of the reservoir 313 and/or by a pump, which second pressure component acts uniformly at all points of the roller wall 316. The hydrostatic fluid pressure $p_s$ results as a sum of the first and second pressure component and fluctuates between a minimum pressure (at the uppermost point of the roller wall 316) and a maximum pressure (at the lowermost point of the roller wall 316). The controller 305 may be configured to adjust the hydrostatic fluid pressure $p_s$ at a defined point of the roller wall 316 (for example the minimum pressure or the maximum pressure) to a defined nominal pressure value.

The cavity 319 of the application roller 310 is preferably entirely filled with finish 302 (as depicted in FIG. 3*a*). A bubble formation (in particular of air bubbles) within the cavity 319 of the application roller 310 may thus be avoided, which enables a particularly uniform application of finish. The adjustment of the fluid pressure $p_s$ and/or of the differential pressure $p_s-p_u$ may then take place from outside the application roller 310 via the supply line 315. In particular, the fluid pressure $p_s$ in the cavity 319 of the application roller 310 may take place via adjustment of the fill level in the reservoir 313 (via the principle of communicating vessels).

The application roller 310 is driven by an electrical motor (not shown) so that the application roller 310 rotates about the axis 312 in the rotation direction 301. The application roller 310 may thereby be moved synchronously with the transport movement of the substrate 120 to be finished, in order to roll the application roller 310 on the surface of the substrate 120 directly or indirectly (via a transfer roller 320), and in order to thereby transfer finish 302 from the outer shell surface 317 of the application roller 310 onto the surface of the substrate 120. As depicted in FIG. 3*a*, the transfer of finish 302 may thereby take place indirectly via a transfer roller 320 that is rotated about an axis 322 synchronously with the application roller 310, and that takes up finish 302 from the outer shell surface 317 of the application roller 310 at a first transfer point and transfers said finish 302 onto the surface of the substrate 120 at a second transfer point. The surface of the transfer roller 320 may be cleaned by means of a blade 321 that is arranged after the second transfer point and before the first transfer point in the rotation direction 301.

The application roller 310 may possibly have an elastic shell surface 317 and/or an elastic roller wall 316. A direct transfer from the application roller 310 onto the surface of the substrate 120 may thus reliably take place.

In an exemplary embodiment, in order to enable a regionally selective finishing of the surface of a substrate 120, the finish group 170 has a knockback pressure generator 330 that is configured to push the finish 302 arranged in the roller wall 316 of the application roller 310, in particular in the pores 311 of the roller wall 316, back in the direction of the cavity 319 of the application roller 310 in a regionally selective manner. The knockback pressure generator 330 is thereby arranged before the (first) transfer point to the transfer roller 320 and/or to the substrate 120, in the rotation direction 301 of the application roller 310.

In an exemplary embodiment, the knockback pressure generator 330 has at least one nozzle 332 that is configured to produce a knockback pressure $p_{ü}$ on the outer shell surface 317 of the roller wall 316 at a defined point of said outer shell surface 317 of the roller wall 316 of the application roller 310. In an exemplary embodiment, the knockback pressure generator 330 includes a plurality of nozzles 332 (or one nozzle subdivided into a plurality of segments) along a line on the outer shell surface 317 of the roller wall 316 of the application roller 310, said line traveling in the transverse direction 2. In an exemplary embodiment, the plurality of nozzles 332 is configured to respectively produce a knockback pressure $p_{ü}$ on the outer shell surface 317 of the roller wall 316 at a different defined point of the outer shell surface 317 of the roller wall 316 of the application roller 310.

In an exemplary embodiment, the knockback pressure $p_{ü}$ is greater than the fluid pressure $p_s$ in the cavity 319 of the application roller 310 (for example by a factor of 2 or more, 5 or more, or 10 or more). As a result of this, at the defined point of the outer shell surface 317 of the roller wall 316 at which the knockback pressure $p_{ü}$ is produced, the finish 302 is pushed away from the outer shell surface 317, back toward the cavity 319 of the application roller 310.

FIG. 3*b* shows different segments 353, 354 of the roller wall 316 of the application roller 310 in an unrolled or planar depiction. In particular, FIG. 3*b* shows a longitudinal section through the porous roller wall 316 (along the transverse direction 2). FIG. 3*b* shows a segment 353 in which a knockback pressure $p_{ü}$ has been produced on the outer shell surface 317 of the roller wall 316, such that the finish 302 in this segment 353 has been pushed away from the outer shell surface 317, and therefore exhibits a relatively large distance 351 from the outer shell surface 317 of the roller wall 316. Furthermore, FIG. 3*b* shows a segment 354 in which no knockback pressure $p_{ü}$ has been produced on the outer shell surface 317 of the roller wall 316, and thus the finish 302 in this segment 354 has not been pushed away from the outer shell surface 317, and therefore exhibits only a relatively small distance or no distance 351 from the outer shell surface 317 of the roller wall 316, and thus may exit from the roller wall 316.

In an exemplary embodiment, the knockback pressure generator 330 includes an (on-off) valve 333 that is configured to selectively couple the nozzle 332 of the knockback pressure generator 300 with a (relatively low) first pressure 334 (for example the ambient pressure) or with a (relatively high) second pressure 334 (for example the knockback pressure $p_{ü}$). In an exemplary embodiment, the switching between the first pressure 334 and the second pressure 335 takes place arbitrarily during the rotation of the application roller 310 so that, per segment, finish 302 is pushed away from the outer shell surface 317 of the application roller 310 (as illustrated in segment 353 of FIG. 3*b*) or not pushed away (as illustrated in segment 354 of FIG. 3*b*).

FIG. 3*b* illustrates the distance 351 of the finish 302 within the roller wall 316 of an application roller 310 immediately after passing the knockback pressure generator 330. A defined point of the outer shell surface 317 of the application roller 310 is rotated from the knockback pressure generator 330 to the (first) transfer point, at which finish 302 should be transferred onto a transfer roller 320 and/or onto a substrate 120 in a regionally selective manner. During the transport of the defined point of the outer shell surface 317 of the application roller 310 to the transfer point, the extrusion force 352 (produced by the fluid pressure $p_s$ in the cavity 319 of the application roller 310) acts on the finish 302 so that the finish 302 moves toward the outer shell surface 317 of the application roller 310.

In a segment 353 that has been knocked back, the distance 351 of the finish 302 from the outer shell surface 317 may be such that the finish 302 at the transfer point continues to be distant from the outer shell surface 317 of the application roller 310, and thus no finish 302 is transferred. On the other hand, in a segment 354 that has not been knocked back, the distance 351 may be low, such that the finish 302 exits on the outer shell surface 317 of the application roller 310 at the transfer point, and thus finish 302 is transferred.

FIG. 3*c* shows the arrangement (corresponding to FIG. 3*b*) of the finish 302 in or on the roller wall 316 of the application roller 310 upon reaching the transfer point. As is clear from FIG. 3*c*, even at the transfer point, the finish 302 in the segment 353 that has been knocked back has not yet reached the outer shell surface 317 of the application roller 310, whereas in the segment 354 that has not been knocked back, finish 302 has already exited from the outer shell surface 317 of the application roller 316. A finish application may be produced or suppressed per segment by pushing back the finish 302 per segment.

In an exemplary embodiment, the nozzle 332 of the knockback pressure generator 330 is subdivided into a plurality of segments 336 or into a plurality of sub-nozzles along the transverse direction 2 or along the rotation axis 312 of the application roller 310, as depicted in FIGS. 3*d* and 3*e*. It is thereby enabled to selectively finish or not finish different segments of a substrate 120. In other words, via the segmentation of the knockback pressure generator 330 along the transverse direction 2 it is enabled to also implement a regionally selective finishing transversal to the rotation direction 301.

As depicted in FIG. 3*d*, the supply line 315 for finish 302 may be directed via the end face 318 of the hollow application roller 310 into the cavity 319 of the application roller 310. Furthermore, FIG. 3*a* shows a blade 331 that is arranged before the knockback pressure generator 330, in the rotation direction 301, and that is configured to clean finish 302 off of the outer shell surface 317 before the regionally selective knockback, in order to increase the reliability of the knockback maneuver.

The finish group 170 according to one or more exemplary embodiments may include a porous tube, a porous hollow cylinder, or a porous application roller 310 made of ceramic, metal, or plastic, the inside 319 of which is filled with the fluid 302 to be applied (in particular with finish). Via partial application of a differential pressure between the inside and outside of the roller wall 316, the fluid 302 located in the pores 311 may be displaced inward or outward. The differential pressure between the inside and outside of the application roller 310, the pore size of the pores 311, and/or the viscosity of the fluid 302 that is used may thereby be matched to one another such that a desired quantity of fluid 302 is available on the outer shell surface 317 of the application roller 310 at the transfer point with a transfer roller 320 (coated with rubber, for example) and/or with a substrate 120. A 50:50 split of the fluid 320 located on the outer shell surface 317 of the application roller 310 typically takes place at the transfer point.

In an exemplary embodiment, in order to enable a precise dosing of the finish quantity, a blade 331 may be arranged at a defined point on the porous application roller 310, which blade corrects inhomogeneities of the fluid layer on the outer shell surface 317 of the application roller 317 from the preceding cycle. The pore size of the pores 311 is preferably small, such that no structuring produced by the pores 311 can be detected on the substrate 120. The distribution of the pores 311, or of the flow resistance resulting therefrom, is preferably uniform along the entire roller wall 316, such that approximately the same finish quantity exits at every point of the roller wall 316 given the same differential pressure per unit of time. In other words, the roller wall 316 may have a distribution of pores 311 that is homogeneous over the entire circumference, with respectively identical passage cross section (at least on average).

Via the knockback pressure generator 330 according to one or more exemplary embodiments, an overpressure (in particular the knockback pressure 335) may be applied in defined regions on the outer shell surface 317 of the application roller 310 after the blade 331, which overpressure is significantly above the differential pressure, so that the fluid 302 is pushed back into the cavity 319 of the application roller 310. The fluid 302 is thereby preferably not pushed back so strongly that the interface of the fluid 302 within the roller wall 316 reaches the inside of the roller wall 316. In other words, in an exemplary embodiment, the knockback pressure 335 is small enough such that the fluid 302 is not pushed entirely back into the cavity 319 of the application roller 310, and some fluid 302 continues to remain in the pores 311 in this region of the roller wall 316.

If a surface element of the outer shell surface 317 of the roller wall 316 leaves the knockback point at which the knockback pressure 335 was produced, and continues to move in the direction of the transfer point, the differential pressure (for example the hydrostatic pressure of the fluid 302) has the effect that the interface between the fluid 302 and air within the roller wall 316 is again displaced outward toward the outer shell surface 317 of the roller wall 316, meaning that the fluid 302 is again pushed outward due to the internal pressure.

As presented above, in an exemplary embodiment, the knockback pressure generator 330 may be subdivided into segments 336 along the transverse direction 2 in which a knockback pressure 335 may respectively be individually applied. The number of segments 336 determines the resolution of the regionally selective fluid application along the transverse direction 2. For example, different segments 336 for different finish-free regions 202 of a print image may be provided on a substrate 120. The segments 336 may possibly be displaceable or adjustable so that the segment boundaries may be manually or automatically displaced (for example depending on position of the finish-free regions 202 of a print image on a substrate 120).

The resolution in the longitudinal direction or transport direction 1 is determined by the speed with which the knockback pressure 335 may be switched on or off (for example by means of the valve 332). The knockback pressure generator 330 may possibly have a segmentation in the transport direction 1 so that two or more sub-regions in the transport direction 1 may be separately activated in order to increase the switching speed of the knockback pressure 335.

Given a suitable design of the pressure ratios, the pore sizes, and the viscosity of the fluid 302, an applied knockback pressure 335 in a segment 353 of the outer shell surface 317 of the application roller 310 leads to the situation that the interface between fluid 302 and air has not yet reached the outer shell surface 317 of the application roller 310 upon reaching the transfer point, whereby no fluid 302 is transferred in this segment 353. On the other hand, if no knockback pressure 335 is applied in a segment 354 of the outer shell surface 317 of the application roller 310, the differential pressure leads to an exit of fluid 302 on the outer shell surface 317 of the application roller 310.

The transfer point (in particular the roller nip) between the application roller 310 and the transfer roller 320 or the substrate 120 is preferably designed such that, at the transfer point, a fluid film is split approximately 50:50 via film splitting and transferred onto the substrate 120 (meaning that 50% transfers onto the transport roller 320 or the substrate 120, and 50% remains on the application roller 310). Preferably, no squeezing of the fluid film thereby takes place in the nip of the transfer point, in order to avoid a "smearing" of the regionally selective fluid film. Following the transfer of the fluid film, a cleaning of the application roller 310 (by the blade 331) and/or of the transfer roller 320 (by the blade 321) may take place.

FIG. 4 shows a flowchart of a method 400, according to an exemplary embodiment, for application of a fluid 302 (in particular of a finish) onto a substrate 120 (in particular onto a (printed) recording medium). In an exemplary embodiment, the method 400 includes producing 401 the effect that fluid 302 moves with a extrusion speed from the cavity 319 of a hollow or hollow cylindrical application roller 310, through a porous roller wall 316 of the application roller, toward the outer shell surface 317 of the application roller 310 due to the higher internal pressure in the cavity 319. The extrusion speed of the fluid 302 may thereby be adjusted by adjusting the fluid pressure of the fluid 302 in the cavity 319 of the application roller 310 *in particular of the fluid pressure relative to the ambient pressure at the outer shell surface 317 of the application roller 310).

In an exemplary embodiment, the extrusion speed typically depends on a target quantity of fluid 302 that should be transferred onto a substrate 120. In other words, the extrusion speed may be adjusted (for example by adjusting the internal pressure in the cavity 319 of the application roller 310) such that a defined target quantity of fluid 302 may be transferred onto a substrate 120 at a transfer point. The extrusion speed thereby typically depends on an external or ambient pressure (in addition to the internal pressure), on the porosity of the roller wall 316, on the number and/or the size of the pores 311, on the thickness of the roller wall 316, on the viscosity of the fluid 302, and/or on the flow resistance of the roller wall 316.

Moreover, in an exemplary embodiment, the method 400 includes the rotation 402 of the application roller 310 with a rotation speed in a rotation direction 301. For this purpose, the application roller 310 is driven by means of an electrical motor.

In an exemplary embodiment, the method 400 also includes the selective production 403 of a knockback pressure 335 at a knockback point on the outer shell surface 317 of the rotating application roller 310, said knockback point being arranged before a transfer point to the substrate 120 in the rotation direction 301, in order to regionally selective push fluid 302 away from the outer shell surface 317 of the application roller 310, toward the cavity 319 of the application roller 310. The knockback point may, for example, be arranged at an angular distance of between 20° and 90° before the transfer point. A direct transfer onto a substrate 120 or an indirect transfer onto a substrate 120 (by means of an additional transfer roller 320) may take place at the transfer point.

In an exemplary embodiment, the extrusion speed, the rotation speed, and the knockback pressure 335 (and possibly the distance between knockback point and transfer point) may be matched to one another such that, in a first region of the outer shell surface 317 of the application roller 310 in which the knockback pressure 335 has been produced at the knockback point, no fluid 302 is located on the outer shell surface 317 of the application roller 310 when the first region reaches the transfer point. No application of fluid 302 onto the substrate 120 thus takes place in the first region.

The extrusion speed, the rotation speed, and the knockback pressure 335 (and possibly the distance between knockback point and transfer point) may also be matched to one another such that, in a second region of the outer shell surface 317 of the application roller 310 in which the knockback pressure 335 has not been produced at the knockback point, fluid 302 (for example a target quantity of fluid 302) is located on the outer shell surface 317 of the application roller 310 when the second region reaches the transfer point. An application of fluid 302 onto the substrate 120 thus takes place in the second region.

In one or more exemplary embodiments, an application group 170 is configured for regionally selective application of a fluid 302 onto a substrate 120. The fluid 302 may include a (dispersion) finish. The substrate 120 may also be a recording medium in the form of a band, sheet, page, or plate that has been printed to in advance. In particular, the application group 170 described in this document may be configured to prevent an application of fluid 302 in one or more regions 202 of a print image printed onto the substrate 120 (for instance for a folding box 200) (in particular in one or more regions 202 that should subsequently be glued), and to produce an application of fluid 302 in one or more additional regions 301 of the print image.

In an exemplary embodiment, the application group 170 includes a hollow application roller 310 having a porous roller wall 316, wherein a fluid 310 to be applied onto a substrate 120 is located in a cavity 319 of the application roller 310 that is surrounded by the roller wall 316. The application roller 310 may be designed such that the fluid 302 moves with an extrusion speed through the roller wall 316, toward the outer shell surface 317 of the application roller 310. The extrusion speed typically depends on the size of the pores 311 of the roller wall 316, and/or on the viscosity of the fluid 302, and/or on the rotation speed of the application roller 310, and/or on the target quantity of fluid 302 that should be transferred onto a substrate 120.

In an exemplary embodiment, the application group 170 includes a pressure means 313, 314, 315 that is configured to adjust a physical fluid pressure (in particular a hydrostatic pressure) of the fluid 302 in the cavity 319 of the application roller 310 in order to adjust the extrusion speed of the fluid 302. For example, the pressure means 313, 314, 315 may be configured to adjust the fill level of the fluid 302 in the cavity 319 in order to adjust the fluid pressure and therefore the extrusion speed of the fluid 302. In an exemplary embodiment, the pressure means 313, 314, 315 is configured to adjust the fill level of the fluid 302 in the reservoir 313 for the fluid 302 in order to adjust the fluid pressure and therefore the extrusion speed of the fluid 302. The cavity 319 is thereby preferably completely filled with fluid 302 in order to enable a particularly uniform application of fluid 302 onto a substrate 120. In an exemplary embodiment, the pressure means 313, 314, 315 is a pressure and/or vacuum pump.

Moreover, in an exemplary embodiment, the application group 170 includes a movement means that is configured to rotate the application roller 310 with a rotation speed in a rotation direction 301. The movement means can include a motor (e.g. electric motor) or drive in one or more embodiments. The rotation speed thereby typically depends on the transport velocity of the substrate 120 and/or may be synchronized with the transport velocity of the substrate 120, in particular in order to produce the effect that the application roller 310 or an additional transfer roller 320 used for the transfer of fluid 302 rolls on the substrate 120. It is noted that, while a rolling of the application roller 310 is advantageous, an application of fluid 302 may also take place even given an unsynchronized movement of the application roller 310.

In an exemplary embodiment, the application group 170 also includes a knockback pressure generator 330 arranged, in the rotation direction 301, before the (indirect or direct) transfer point to the substrate 120, which knockback pressure generator 330 is configured to regionally selectively push fluid away from the outer shell surface 317 of the application roller 310, toward the cavity 319 of the application roller 310, by producing a knockback pressure 335. The knockback pressure 335 must thereby be greater than the fluid pressure in the cavity 319 of the application roller 310 (in particular by a factor of 2 or more, 5 or more, or 10 or more).

The extrusion speed, the rotation speed, and the knockback pressure 335 are matched to one another such that, in a first region of the outer shell surface 317 of the application roller 310 in which the knockback pressure 335 has been produced by the knockback pressure generator 330, (essentially) no fluid 302 is located on the outer shell surface 317 of the application roller 310 when the first region reaches the transfer point. Furthermore, the extrusion speed, the rotation speed, and the knockback pressure 335 are matched to one another such that, in a second region of the outer shell surface 317 of the application roller 310 in which the knockback pressure 335 has not been produced, fluid 302 is located on the outer shell surface 317 of the application roller 310 when the second region reaches the transfer point. A regionally selective application of fluid 302 onto a substrate 120 may thus be efficiently produced.

An application group 170 having an application roller 310 and a knockback pressure generator 330 is thus described. Via the internal pressure or fluid pressure of the fluid 302 in the application roller 310, it is thereby produced that fluid 302 is pushed outward through the pores 311 of the application roller 310. Via the knockback pressure generator 331, for a region 202 that is free of finish it is produced that the fluid 302 is pushed inward such that, even after the rotation of the application roller 310 up to the transfer point, the fluid 302 has not (possibly has not again) arrived at the outer shell surface 317, and thus is also not transferred onto a transfer roller 320 and/or a substrate 120.

In an exemplary embodiment, the knockback pressure generator 330 includes a nozzle 332 having a nozzle opening that is directed toward the outer shell surface 317 of the application roller 310, wherein the nozzle opening has a defined cross section. The cross section of the nozzle opening may be 2 cm or smaller along the rotation direction 301. The nozzle 332 may be configured to produce the knockback pressure 335 on a region of the outer shell surface 317 of the application roller 310 that is delimited depending on the cross section of the nozzle 332. By using a nozzle 332 having a defined nozzle opening, the spatial resolution of the regionally selective fluid application may be increased. In particular, the spatial resolution of the regionally selective fluid application may be adjusted via the size of the cross section of the nozzle opening. The resolution may thereby be increased by reducing the cross section size.

In an exemplary embodiment, the knockback pressure generator 330 includes a valve 33 that is configured to couple the nozzle 332 in a regionally selective manner with a compressed, gaseous knockback fluid, in particular with compressed air, in order to produce the knockback pressure 335. Furthermore, the valve 333 may be configured to selectively decouple the nozzle 332 from the compressed, gaseous knockback fluid and/or couple the nozzle 332 with a gaseous fluid that has a reduced physical pressure 334 (for example the ambient pressure) in comparison to the knockback fluid, in order to not produce the knockback pressure 335. By switching the valve 333 on or off, the knockback pressure 335 may be efficiently produced or not produced as needed in defined regions of the outer shell surface 317 of the application roller 310 (in order to produce no fluid application or a fluid application).

In an exemplary embodiment, the knockback pressure generator 330 includes a plurality of segments 336 (for example 3 or more, 5 or more, or 10 or more segments 336) along the rotation axis 312 of the application roller 310 (meaning axially along the outer shell surface 317 of the application roller 310). The knockback pressure generator 330 may be configured to selectively produce or not produce the knockback pressure 335 in each of the plurality of segments 336. The spatial resolution of the regionally selective fluid application along the rotation axis 312 may be increased by providing different segments 336.

The plurality of segments 336 may be designed such that at least one segment boundary between two (directly) adjacent segments 336 may be manually or automatically displaced along the rotation axis 312 of the application roller 310. An efficient adaptation of the regionally selective fluid application to different requirements (for example to different positions of regions without finish) may thus be enabled.

In an exemplary embodiment, the application group 170 includes a blade 331 arranged before the knockback pressure generator 330 in the rotation direction 301. In an exemplary embodiment, the blade 331 is configured to remove fluid 302 from the outer shell surface 317 of the application roller 310. The quality of the regionally selective fluid application may be increased via the cleaning of the outer shell surface 317 of the application roller 310.

As already presented above, the application group 170 may include a transfer roller 320 that, with the application roller 310, forms a roller nip at the transfer point. The transfer roller 320 may be configured to take up fluid 302 from the outer shell surface 317 of the application roller 310 and transfer it to a substrate 120 at a second transfer point. The quality of the regionally selective fluid application may be further increased via the use of a transfer roller 320 (in particular of a transfer roller having an elastic surface).

The roller wall 316 of the transfer roller 310 has preferably radially traveling pores 311. In other words, the pores 311 of the roller wall 316 are preferably designed such that the fluid 302 is (at least for the most part) pushed in the radial direction through the roller wall 316 to the outer shell surface 317. Alternatively or additionally, the pores 311 may be designed such that the molecules of the fluid 302 travel (on average) a path in the tangential direction that is 90% or less, 80% or less, or preferably 50% or less of the thickness of the roller wall 316 in the radial direction on the way from the inner shell surface (on the inside of the roller wall 316) up to the outer shell surface 317. For example, the pores 311 may be designed as radially traveling capillaries through the roller wall 316.

The spatial resolution between regions 202 free of finish and finished regions 201 may be increased via the use of an application roller 310 having primarily radial traveling pores 311.

The transfer point for a fluid transfer from the application roller 310 onto a transfer roller 320 and/or onto a substrate 120 is preferably arranged below, in particular at the lowermost point of the application roller 310, since at this point the fluid pressure of the fluid 302 on the roller wall 316 is highest, and thus a particularly reliably fluid transfer is enabled.

The fluid pressure with which the fluid 302 in the cavity 319 of the application roller 310 acts on a point of the roller wall 316 typically changes with the location of the point of the roller wall 316. The fluid pressure is typically highest when the point of the roller wall 316 is arranged below (and thus the gravitational force acting on the entire fluid column acts as a hydrostatic pressure on the roller wall 316). On the other hand, the fluid pressure is lowest if the point of the roller wall 316 is arranged above (and thus no hydrostatic pressure produced by the gravitational force acts on the roller wall 316). The fluid pressure acting on the roller wall 316 thus varies between a minimum pressure (at an upper point of the roller wall 316) and a maximum pressure (at a lower point of the roller wall 316). The difference between maximum pressure and minimum pressure is thereby the hydrostatic pressure produced by the weight of the fluid 302.

In an exemplary embodiment, the one or more nozzles 332 of the knockback pressure generator 330 are arranged at a point of the roller wall 316 at which the fluid pressure of the fluid 302 is nearer to the maximum pressure than to the minimum pressure. It may thus be ensured that the fluid 302 may be pushed significantly back toward the cavity 319 of the application roller 310 by the knockback pressure generator 330. A clear differentiation is thus enabled between regions 202 free of finish and finished regions 201.

Furthermore, in this document a (digital) printing device 100 is described that includes at least one of the application groups 170 described in this document (for example for application of a primer or for application of finish).

The measures described in this document enable a fluid 302 (for example a primer or a finish) to be efficiently and precisely applied digitally onto a substrate 120 with a defined resolution in a transport direction 1 and/or in a transverse direction 2.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc.

Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
2 transverse direction
21, 22 nozzle (print image)
31, 32 column (of the print image)
100 printing device
101 controller
102 print bar
103 print head
120 substrate (recording medium)
140 print group
150 fixing unit
170 application group (finish group)
200 folding box for a packaging
201 print region
202 region without finish
301 rotation direction
302 fluid (finish)
305 controller (application group)
310 application roller (finish roller)
311 pores
312 axis (application roller)
313 reservoir (fluid)
314 sensor
315 supply line
316 roller wall
317 outer shell surface (roller wall)
318 end face (application roller)
319 cavity (application roller)
320 transfer roller
321 blade
322 axis (transfer roller)
330 knockback pressure generator
331 blade
332 nozzle (of knockback pressure generator)
333 (on/off) valve
334 first physical pressure (ambient pressure)
335 second physical pressure (knockback pressure)
336 segment
351 distance (to the outer shell surface of the application roller)
352 extrusion force
353 segment that has been knocked back
354 segment that has not been knocked back
400 method for regionally selective application of a fluid
401-403 method steps

The invention claimed is:

1. An application group for applying a fluid onto a substrate, the application group comprising:

a hollow cylindrical application roller having a porous roller wall and a cavity, the fluid to be applied onto the substrate being located in the cavity, wherein the fluid moves with an extrusion speed through the roller wall to an outer shell surface of the application roller due to an internal pressure of the application roller;

a drive configured to rotate the application roller with a rotation speed in a rotation direction; and a knockback pressure generator arranged before a transport point to the substrate, in the rotation direction, and configured to generate a knockback pressure to regionally selectively push a portion of the fluid away from the outer shell surface of the application roller and towards the cavity of the application roller, wherein the extrusion speed, the rotation speed, and the knockback pressure are matched to one another such that:

in a first region of the outer shell surface of the application roller in which the knockback pressure has been produced by the knockback pressure generator, minimal or no fluid is located on the outer shell surface of the application roller when the first region reaches the transfer point; and in a second region of the outer shell surface of the application roller in which the knockback pressure has not been produced, fluid is located on the outer shell surface of the application roller when the second region reaches the transfer point.

2. The application group according to claim 1, wherein:

the knockback pressure generator comprises a nozzle having a nozzle opening that is directed toward the outer shell surface of the application roller;

the nozzle opening has a cross section; and the nozzle is configured to produce the knockback pressure on a region of the outer shell surface of the application roller that is delimited depending on the cross section of the nozzle.

3. The application group according to claim 2, wherein the knockback pressure generator comprises a valve that is configured to regionally selectively:

couple the nozzle with a compressed gaseous knockback fluid to produce the knockback pressure; and decouple the nozzle from the compressed gaseous knockback fluid, and/or couple the nozzle with a gaseous fluid that has a physical pressure that is less than the knockback pressure to stop the production of the knockback pressure.

4. The application group according to claim 3, wherein the compressed gaseous knockback fluid is compressed air.

5. The application group according to claim 1, wherein:

the knockback pressure generator includes a plurality of segments axially along the outer shell surface of the application roller; and the knockback pressure generator is configured to selectively produce the knockback pressure in each of the plurality of segments.

6. The application group according to claim 5, wherein the plurality of segments are configured such that at least one segment boundary between two adjacent segments of the plurality of segments are manually or automatically displaced along the rotation axis of the application roller.

7. The application group according to claim 1, wherein:

the application group comprises a pressure pump that is configured to adjust a hydrostatic fluid pressure in the cavity of the application roller to adjust the extrusion speed of the fluid; and the fluid pressure is lower than the knockback pressure.

8. The application group according to claim 1, wherein the application group comprises a blade arranged before the knockback pressure generator in the rotation direction, the blade being configured to remove fluid from the outer shell surface of the application roller.

9. The application group according to claim 1, wherein:

the application group comprises a transfer roller that, with the application roller, forms a roller nip at the transfer point; and the transfer roller is configured to take up fluid from the outer shell surface of the application roller and to transfer the fluid to a substrate at a second transfer point.

10. The application group according to claim 1, wherein:

the fluid comprises a finish;

the substrate is a recording medium, in the form of a belt, sheet, page, or plate, that has been printed to in advance; or the application group is configured to suppress an application of fluid in one or more regions of the substrate and to produce an application of fluid onto the substrate in one or more other regions.

11. The application group according to claim 1, wherein:

the fluid comprises a finish;

the substrate is a recording medium, in the form of a belt, sheet, page, or plate, that has been printed to in advance; and the application group is configured to suppress an application of fluid in one or more regions of the substrate and to produce an application of fluid onto the substrate in one or more other regions.

12. A method for applying a fluid onto a substrate, the method comprising:

producing an effect to cause fluid to move with an extrusion speed from a cavity of an application roller, through a porous roller wall, to an outer shell surface of the application roller;

rotating the application roller with a rotation speed in a rotation direction; and selectively generating a knockback pressure at a knockback point on the outer shell surface of the rotating application roller, the knockback point being arranged before a transfer point to the substrate in the rotation direction to regionally selectively push a portion of the fluid away from the outer shell surface of the application roller and towards the cavity of the application roller, wherein the extrusion speed, the rotation speed, and the knockback pressure are matched to one another such that:

in a first region of the outer shell surface of the application roller in which the knockback pressure has been produced by the knockback pressure generator, minimal or no fluid is located on the outer shell surface of the application roller when the first region reaches the transfer point; and in a second region of the outer shell surface of the application roller in which the knockback pressure has not been produced, fluid is located on the outer shell surface of the application roller when the second region reaches the transfer point.

* * * * *